US010767960B2

(12) United States Patent
Noonan et al.

(10) Patent No.: US 10,767,960 B2
(45) Date of Patent: Sep. 8, 2020

(54) REAR SIGHT ASSEMBLY FOR A FIREARM

(71) Applicant: Wilson's Gun Shop, Inc., Berryville, AR (US)

(72) Inventors: Paul T. Noonan, Boise, ID (US); Brent David Boyer, Fayetteville, AR (US); Aaron Neal Trout, Fayetteville, AR (US)

(73) Assignee: Wilson's Gun Shop, Inc, Berryville, AR (US)

( * ) Notice: Subject to any disclaimer, the term of this patent is extended or adjusted under 35 U.S.C. 154(b) by 0 days.

(21) Appl. No.: 15/915,496

(22) Filed: Mar. 8, 2018

(65) Prior Publication Data

US 2019/0017781 A1 Jan. 17, 2019

Related U.S. Application Data

(60) Provisional application No. 62/469,096, filed on Mar. 9, 2017.

(51) Int. Cl.

| | |
|---|---|
| ***F41G 1/26*** | (2006.01) |
| ***F41G 1/10*** | (2006.01) |
| ***F41G 1/18*** | (2006.01) |
| *F41G 11/00* | (2006.01) |

(52) U.S. Cl.

CPC ..... *F41G 1/26* (2013.01); *F41G 1/10* (2013.01); *F41G 1/18* (2013.01); *F41G 11/003* (2013.01)

(58) Field of Classification Search

CPC ..... F41G 1/01; F41G 1/06; F41G 1/10; F41G 1/16; F41G 1/26; F41G 11/003

See application file for complete search history.

(56) References Cited

U.S. PATENT DOCUMENTS

| | | | | | |
|---|---|---|---|---|---|
| 2,162,090 | A * | 6/1939 | King | F41G 1/26 | 42/137 |
| 2,438,601 | A * | 3/1948 | Davis | F41G 1/26 | 42/137 |
| 3,495,339 | A * | 2/1970 | Elliason | F41G 1/26 | 42/137 |
| 5,467,552 | A * | 11/1995 | Cupp | F41G 1/26 | 42/125 |
| 7,032,341 | B1 * | 4/2006 | Sconce | F41G 1/18 | 42/111 |
| 7,526,890 | B1 * | 5/2009 | Keng | F41G 1/18 | 42/111 |
| 8,635,801 | B2 * | 1/2014 | Glimpse | F41G 1/02 | 42/132 |
| 8,893,422 | B2 * | 11/2014 | Wolf | F41A 3/12 | 42/111 |
| 9,506,726 | B2 * | 11/2016 | Wolf | F41G 1/26 | |
| 9,714,811 | B2 * | 7/2017 | Pulit, Jr. | F41G 1/26 | |
| 10,006,740 | B1 * | 6/2018 | Keller | F41G 1/01 | |
| 2007/0199227 | A1 * | 8/2007 | Ertl | F41G 1/10 | 42/137 |
| 2008/0092424 | A1 * | 4/2008 | Keng | F41G 1/18 | 42/137 |

(Continued)

*Primary Examiner* — Benjamin P Lee

(57) ABSTRACT

A rear sight assembly for a firearm is disclosed. The rear sight assembly contain a sight base coupled with the firearm, a sight blade pivotally coupled with the sight base and a tension member positioned between the sight base and the sight blade and configured to push the sight blade against the firearm.

3 Claims, 13 Drawing Sheets

(56) References Cited

U.S. PATENT DOCUMENTS

| | | | | |
|---|---|---|---|---|
| 2009/0013581 | A1* | 1/2009 | LoRocco | F41G 1/345 42/132 |
| 2011/0247258 | A1* | 10/2011 | Gentilini | F41G 1/16 42/135 |
| 2012/0144721 | A1* | 6/2012 | Glimpse | F41G 1/02 42/132 |
| 2013/0061511 | A1* | 3/2013 | Strayer | F41G 1/10 42/136 |
| 2014/0259856 | A1* | 9/2014 | Kruse | F41G 1/16 42/136 |
| 2015/0241175 | A1* | 8/2015 | Wolf | F41G 11/005 42/124 |
| 2016/0223292 | A1* | 8/2016 | Pulit, Jr. | F41G 1/26 |

* cited by examiner

REAR SIGHT ASSEMBLY FOR A FIREARM

CROSS REFERENCE TO RELATED APPLICATIONS

This application claims the benefit of U.S. Provisional Application No. 62/469,096, filed on Mar. 9, 2017, which is incorporated herein by reference in its entirety.

FIELD

The present invention relates to a firearm. More particularly, the present invention relates to a rear sight assembly for a firearm.

BACKGROUND

Adjusting the point of impact for a handgun shooter, is traditionally a complex process requiring a level of skill, that makes it problematic for a consumer to do, without benefit of a gunsmith.

A need exists for an adjustable rear sight for a firearm.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Referring to FIGS. 1-4, a rear sight assembly 10 is shown according to some embodiments presently disclosed. According to some embodiments, the rear sight assembly 10 is coupled to a firearm 14. According to some embodiments, the firearm 14 is a handgun. According to some embodiments, the rear sight assembly 10 is coupled to a slide 12 of the firearm 14. Although the firearm 14 is shown as a handgun, it is to be understood that the rear sight assembly 10 may be coupled with a rifle or any other type of a firearm.

Figure 1:
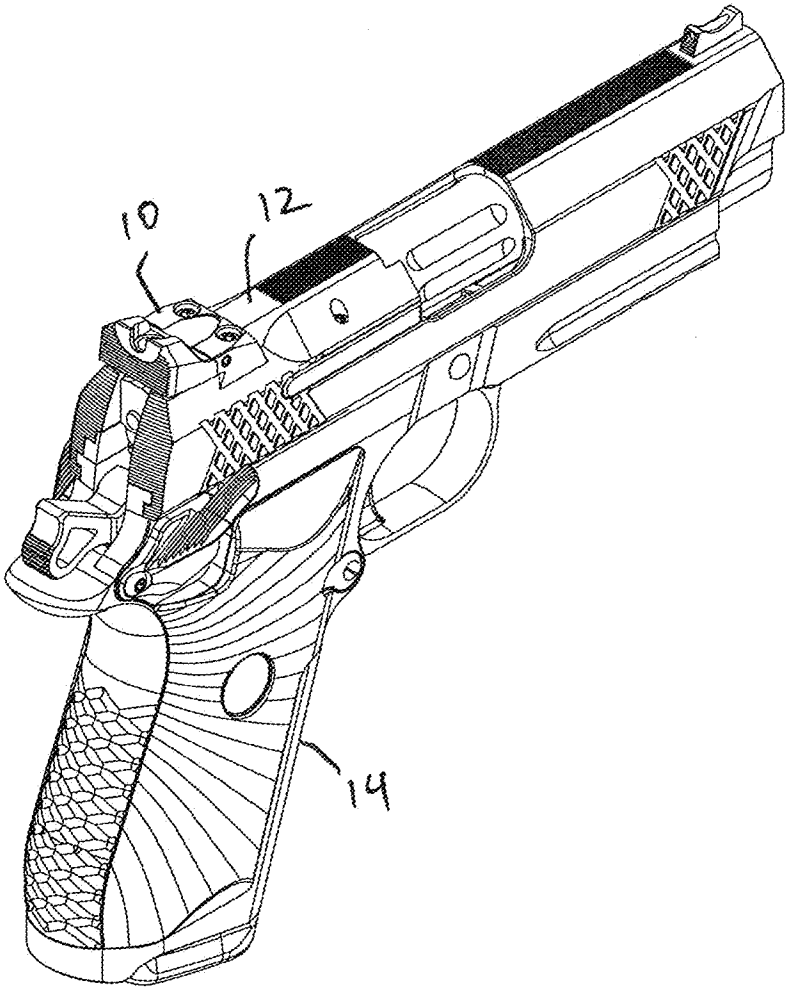
FIG. 1 depicts a rear sight assembly according to the present disclosure coupled with a firearm.
Figure 2:
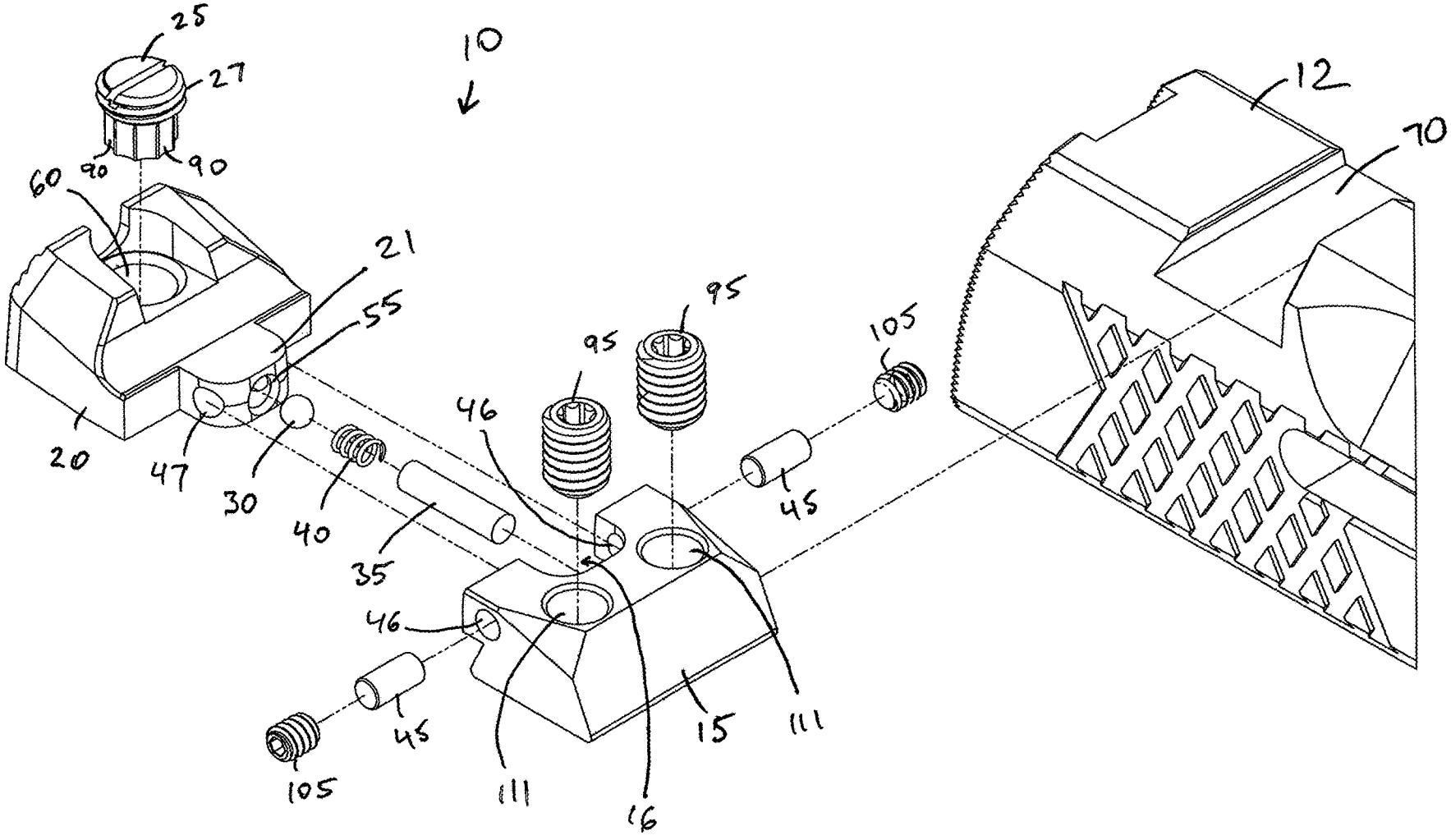
FIG. 2 depicts an exploded view of the rear sight assembly according to the present disclosure.
Figure 3:
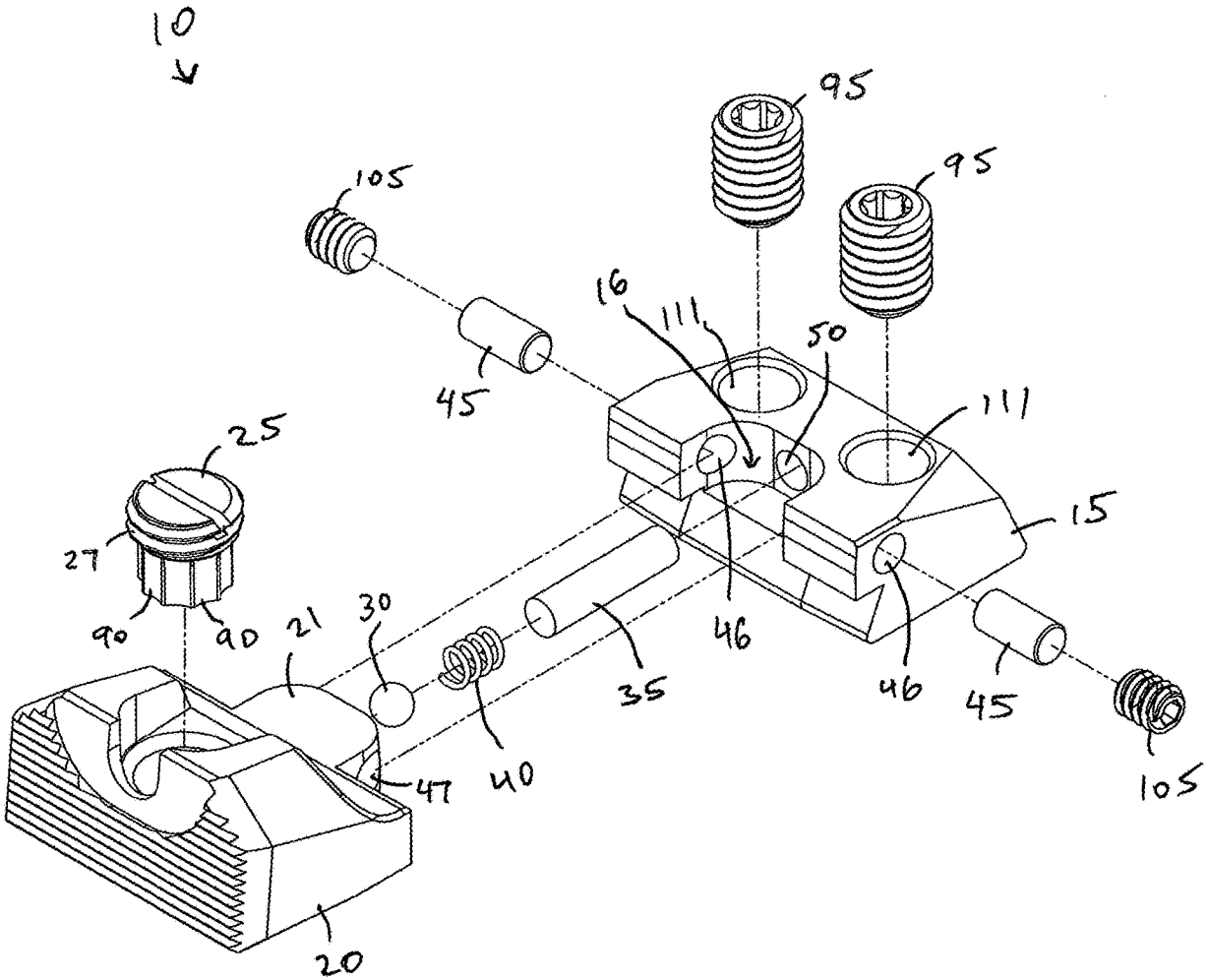
FIG. 3 depicts another exploded view of the rear sight assembly according to the present disclosure.
Figure 4:
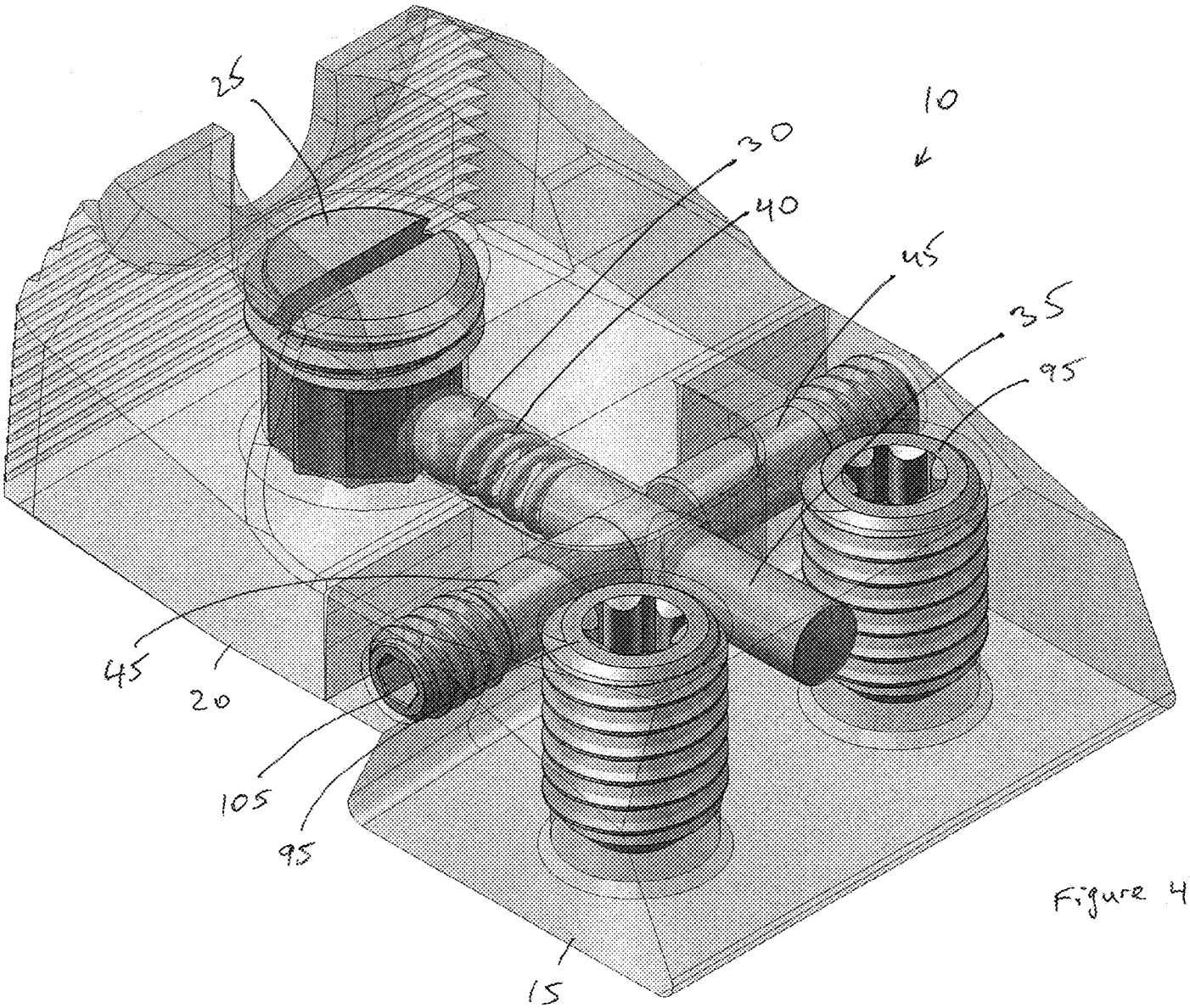
FIG. 4 depicts an assembled, transparent view of the rear sight assembly according to the present disclosure.

Referring to FIGS. 2-3, the rear sight assembly 10 comprises a sight base 15, a sight blade 20, and a tension member 35. The rear sight assembly 10 may also comprise an elevation screw 25.

Referring to FIG. 3, the sight base 15 comprises an opening 50 configured to accommodate a first portion of the tension member 35. Referring to FIG. 2, the sight blade 20 comprises an opening 55 configured to accommodate a second portion of the tension member 35. According to some embodiments, the sight base 15 is pivotally coupled with the sight blade 20 so as to securely retain portions of the tension member 35 in the openings 50 and 55.

According to some embodiments, the sight base 15 is pivotally coupled with the sight blade 20 using one or more fasteners 45 as shown in FIGS. 2-3. The one or more fasteners 45 may be pins, dowel pins, screws, set screws. The sight based 15 may comprise one or more through openings 46 configured to accommodate the one or more fasteners 45. According to some embodiments, the one or more fasteners 45 are configured to abut the tension member 35 when the first portion of the tension member 35 is positioned within the opening 50. According to some embodiments, the one or more fasteners 45 are configured to retain the first portion of the tension member 35 within the opening 50. According to some embodiments, the one or more fasteners 45 are configured to prevent the first portion of the tension member 35 from being removed from the opening 50.

According to some embodiments, the sight blade 20 may comprise one or more through openings 47 configured to accommodate the one or more fasteners 45.

According to some embodiments, the one or more fasteners 45 are configured to abut the tension member 35 when the second portion of the tension member 35 is positioned within the opening 55. According to some embodiments, the one or more fasteners 45 are configured to retain the second portion of the tension member 35 within the opening 55. According to some embodiments, the one or more fasteners 45 are configured to prevent the second portion of the tension member 35 from being removed from the opening 55.

According to some embodiments, the sight base 15 comprises a cavity 16 configured to accommodate a protrusion 21 of the sight blade 20. According to some embodiments, the one or more through openings 47 are positioned in the protrusion 21 of the sight blade 20 as shown in FIG. 2.

According to some embodiments, the one or more through openings 46 are positioned in the cavity 16 of the sight base 15 as shown in FIG. 3.

Figure 5:
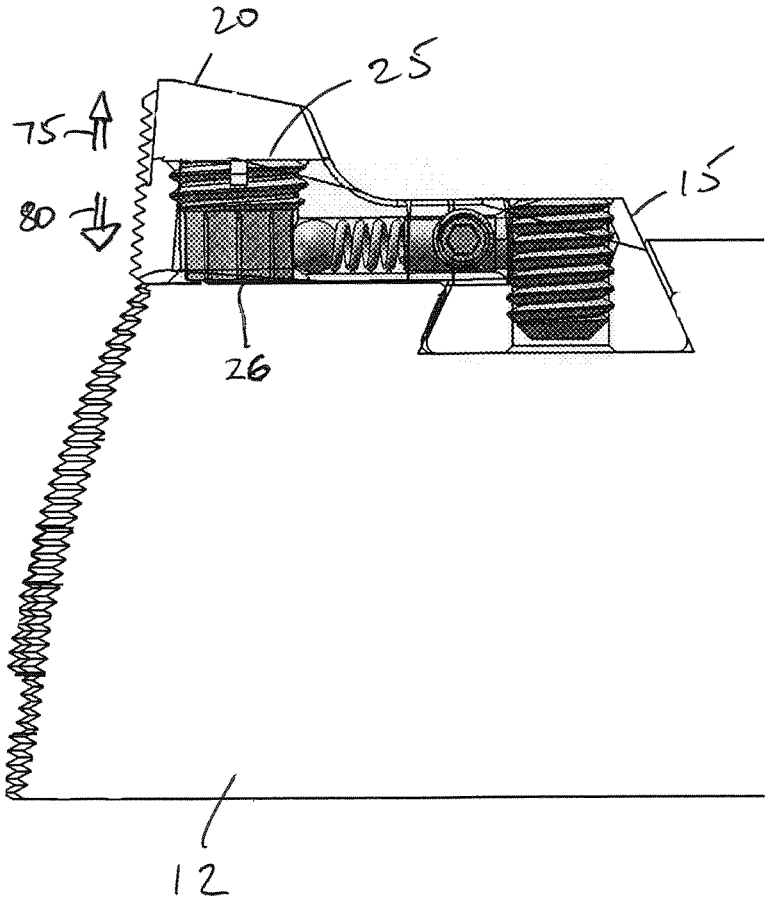
FIG. 5 depicts the rear sight assembly according to the present disclosure coupled with the firearm in a lowered position.

The sight blade 20 may comprise a through opening 60 (shown in FIG. 2) configured to accommodate the elevation screw 25. According to some embodiments, at least a portion of the through opening 60 comprises internal threads (not shown) and at least a portion of the elevation screw 25 comprises corresponding external threads 27 to allow the elevation screw 25 to rotationally move up and down within the through opening 60. According to some embodiments, a lower portion 26 (shown in FIGS. 5-6) of the elevation screw 25 is configured to rotationally enter the through opening 60 from the top end and rotationally exit the through opening 60 from a bottom end to abut the slide 12 as shown in FIGS. 5-6.

Figure 6:
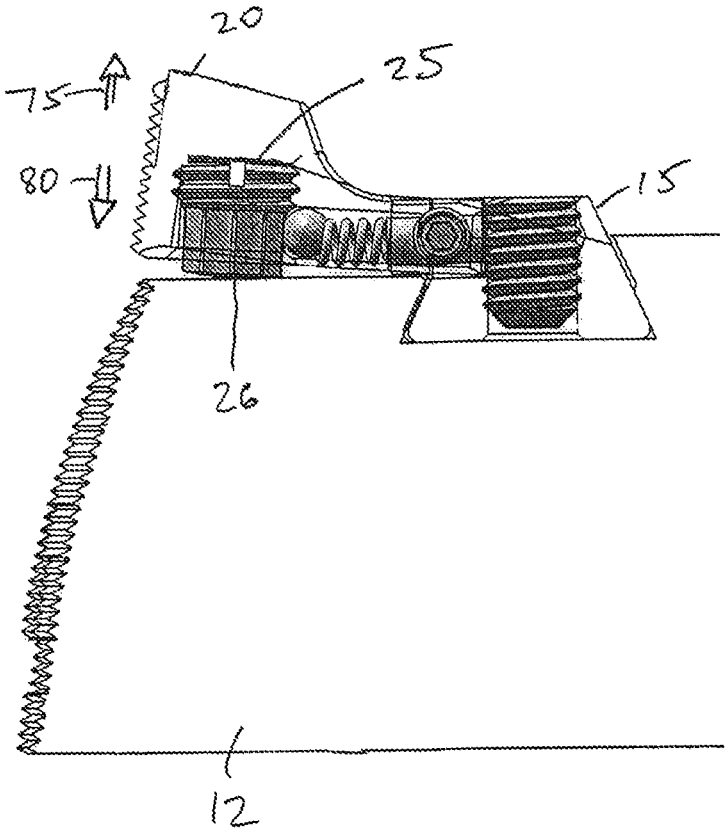
FIG. 6 depicts the rear sight assembly according to the present disclosure coupled with the firearm in a raised position.
Figure 7:
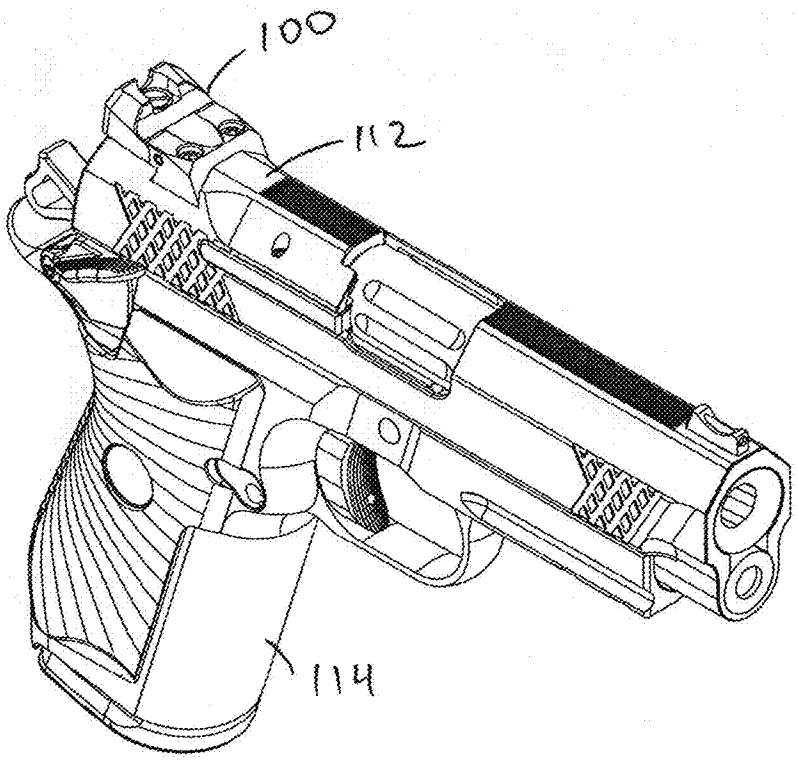
FIG. 7 depicts another rear sight assembly according to the present disclosure coupled with a firearm.

According to some embodiments, the sight base 15 is configured to couple with a firearm 14 as shown in FIG. 6. The firearm 14 may comprise an opening 70 (shown in FIG. 2) configured to accommodate at least a portion of the sight base 15. According to some embodiments, the opening 70 is a dovetail opening configured to accommodate a corresponding dovetail shape of the sight base 15.

According to some embodiments, the lower portion 26 (shown in FIGS. 5-6) of the elevation screw 25 is rounded. According to some embodiments, the lower portion 26 of the elevation screw 25 is configured to apply pressure against the firearm 14 (shown in FIG. 6) when it protrudes through the opening 60. According to some embodiments, the sight blade 20 is configured to move in an upward direction shown by reference number 75 as the lower portion 26 of the elevation screw 25 protrudes the through opening 60 as shown in FIGS. 5-6. According to some embodiments, the second portion of the tension member 35 moves in an upward direction 75 when the sight blade 20 moves in the upward direction 75 while the first portion of the tension member 35 remains stationary. Moving the sight blade 20 in the upward direction 75 causes the tension member 35 to be compressed. According to some embodiments, the tension member 35 is configured to urge (i.e. push) the sight blade 20 away from the sight base 15. According to some embodiments, the tension member 35 is configured to urge (i.e. push) the sight blade 20 against the firearm 14.

According to some embodiments, the compressed tension member 35 allows the lower portion 26 of the elevation screw 25 to apply pressure against the firearm 14. According to some embodiments, the compressed tension member 35 keeps the sight blade 20 seated against the firearm 14 during the operation of the firearm 14.

According to some embodiments, the sight blade 20 is configured to move in a downward direction shown by reference number 80 as the lower portion 26 of the elevation screw 25 is retracted back inside of the through opening 60 as shown in FIGS. 5-6. According to some embodiments, the second portion of the tension member 35 moves in the downward direction 80 when the sight blade 20 moves in the downward direction 80 while the first portion of the tension member 35 remains stationary. Moving the sight blade 20 in the downward direction 80 causes the tension member 35 to at least partially decompress.

Referring to FIGS. 2-3, according to some embodiments, the rear sight assembly 10 may comprise a ball bearing 30 and a spring 40. According to some embodiments, the opening 55 is a through opening configured to accommodate the second portion of the tension member 35, the ball bearing 30 and the spring 40. According to some embodiments, the ball bearing 30 and the spring 40 are disposed in the opening 55 between the tension member 35 and the elevation screw 25. The spring 40 is disposed between the ball bearing 30 and the tension member 35. According to some embodiments, the ball bearing 30 is 3/32 of an inch in diameter.

According to some embodiments, the elevation screw 25 comprises one or more mating cutouts 90 to accommodate the ball bearing 30. The one or more mating cutouts 90 provide an audible "click" every time the elevation screw 25 is turned and the ball bearing 30 migrates (i.e. transitions) from one matting cutout 90 to another matting cutout 90.

According to some embodiments, the elevation screw 25 comprises ten (10) mating cutouts 90. Therefore, the elevation screw 25 is configured to make an audible "click" every time it is turned 36 degrees. According to some embodiments, each "click" is configured to represent a 0.005 inch of movement of the sight blade 20 in the upward direction 75 or a downward direction 80. According to some embodiments, the sight blade 20 is configured to move 0.09 inches in the upward direction 75.

According to some embodiments, the tension member 35 has a diameter that is smaller than the diameter of the opening 55 to allow the tension member 35 to be compressed without interfering with the movement of the sight blade 20 during elevation adjustments.

According to some embodiments, the opening 50 is positioned at a first angle from horizontal to ensure that the sight blade 20 is canted (i.e. sloped) downward prior to being installed on the firearm 14. According to some embodiments, the opening 50 is positioned at a first angle to the horizontal surface of the firearm 14. According to some embodiments, the opening 50 is positioned 2 degree angle to the firearm 14.

According to some embodiments, the rear sight assembly 10 is angled downward prior to installation on the firearm 14 to guarantee the tension member 35 is constantly under load (i.e. tension, compression) once installed on the firearm 14. This ensures no movement of the rear sight assembly 10 during operation of the firearm 14. According to some embodiments, the tension member 35 is under load (i.e. tension, compression) even if the lower portion 26 of the elevation screw 25 is completely retracted back inside of the through opening 60.

Referring to FIGS. 2-3, according to some embodiments, the rear sight assembly 10 may comprise one or more fasteners 105 to retain the one or more pins 45 in the sight blade 20. The one or more fasteners 105 may be set screws. According to some embodiments, the one or more set screws 105 are 4-40×1.25 inch set screw. According to some embodiments, the one or more pins 45 are 3-32×0.1875 dowel pins.

Referring to FIGS. 2-3, according to some embodiments, the rear sight assembly 10 may comprise one or more fasteners 95 to allow a user to adjust the rear sight assembly 10 due to windage. The one or more fasteners 95 may be set screws. The sight base 15 may comprise one or more through openings 111 configured to accommodate the one or more set fasteners 95. According to some embodiments, the sight base 15 slides into a mating dovetail 70 of the firearm 14 and is locked into place by the tightening the one or more fasteners 95 through the one or more openings 111. According to some embodiments, the one or more fasteners 95 are 10-32×0.25 inch torx style set screws.

According to some embodiments presently disclosed, the tension member 35 is a rod. The tension member 35 may comprise nitinol material. The tension member 35 may comprise a metal alloy of nickel and titanium.

Referring to FIGS. 7-11, another rear sight assembly 110 is shown according to some embodiments presently disclosed. According to some embodiments, the rear sight assembly 110 is coupled to a firearm 114. According to some embodiments, the firearm 114 is a handgun. According to some embodiments, the rear sight assembly 110 is coupled to a slide 112 of the firearm 114. Although the firearm 114 is shown as a handgun, it is to be understood that the rear sight assembly 110 may be coupled with a rifle or any other type of a firearm.

Figure 8:
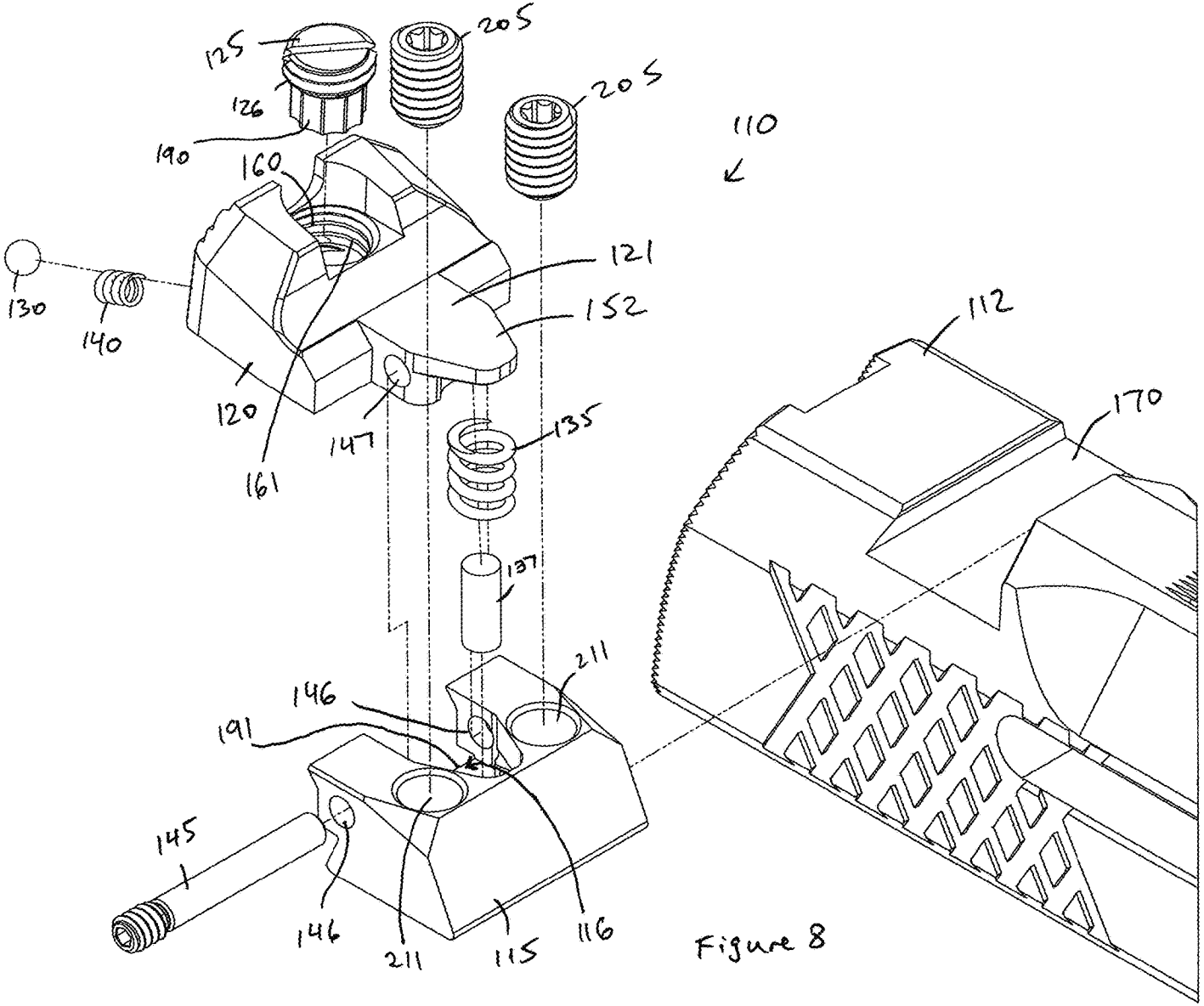
FIG. 8 depicts an exploded view of the rear sight assembly according to the present disclosure.
Figure 9:
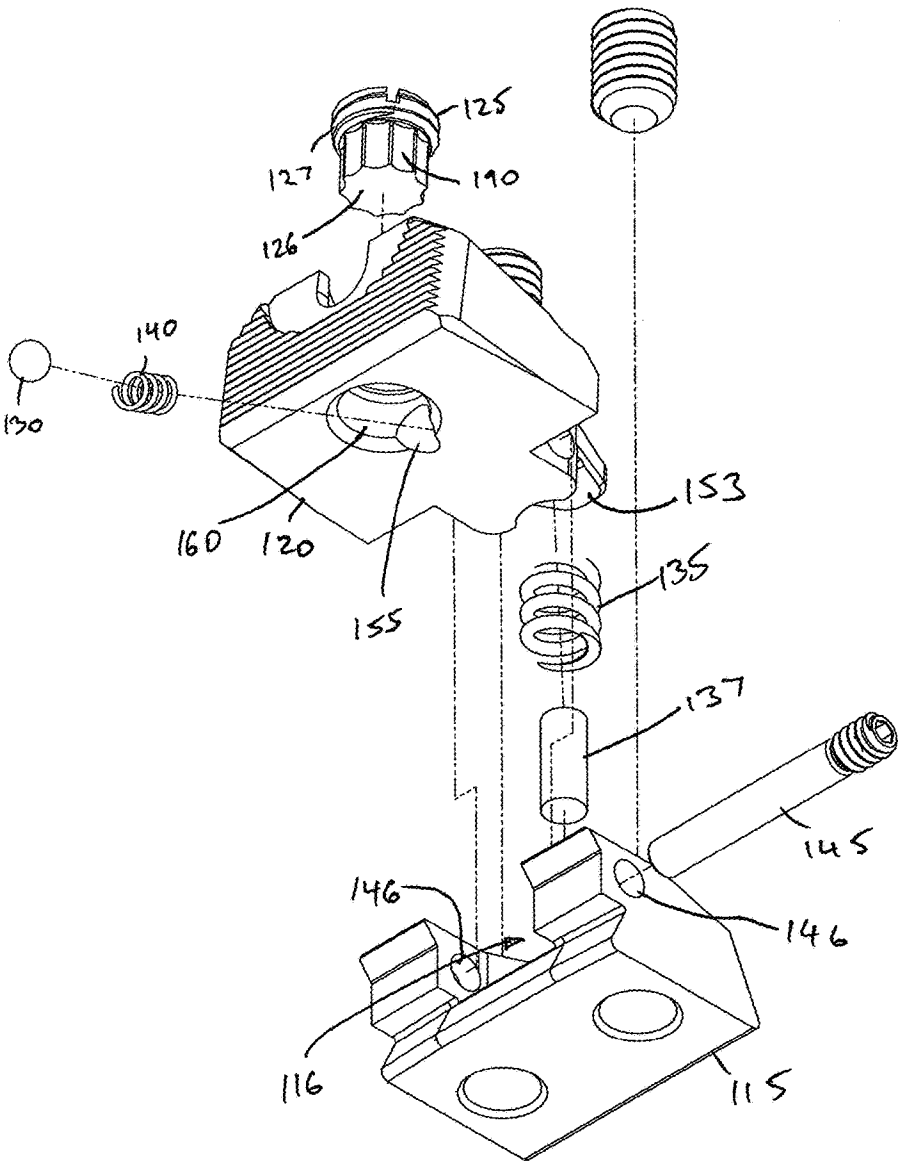
FIG. 9 depicts another exploded view of the rear sight assembly according to the present disclosure.
Figure 10:
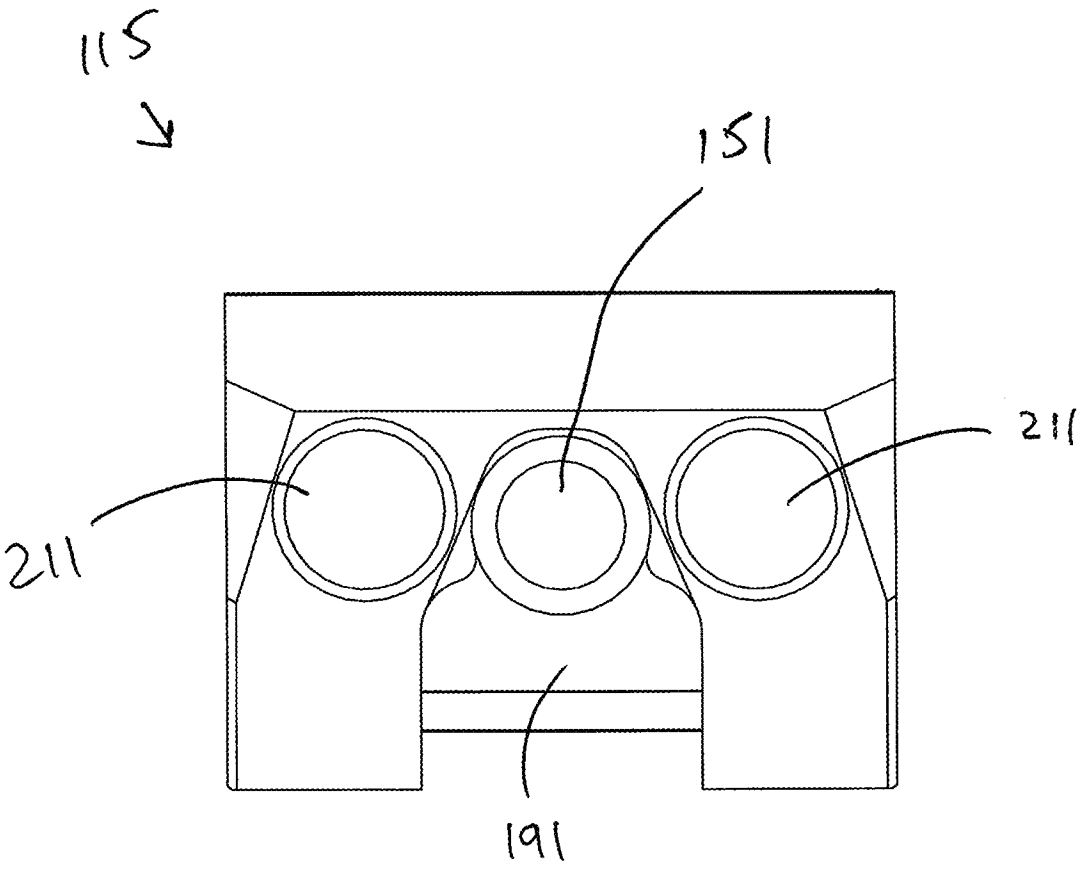
FIG. 10 depicts a top view of the sight base according to the present disclosure.

Referring to FIGS. 8-9, the rear sight assembly 100 comprises a sight base 115, a sight blade 120, and a tension member 135. The tension member 135 may be a spring. The rear sight assembly 100 may also comprise an elevation screw 125.

Figure 11:
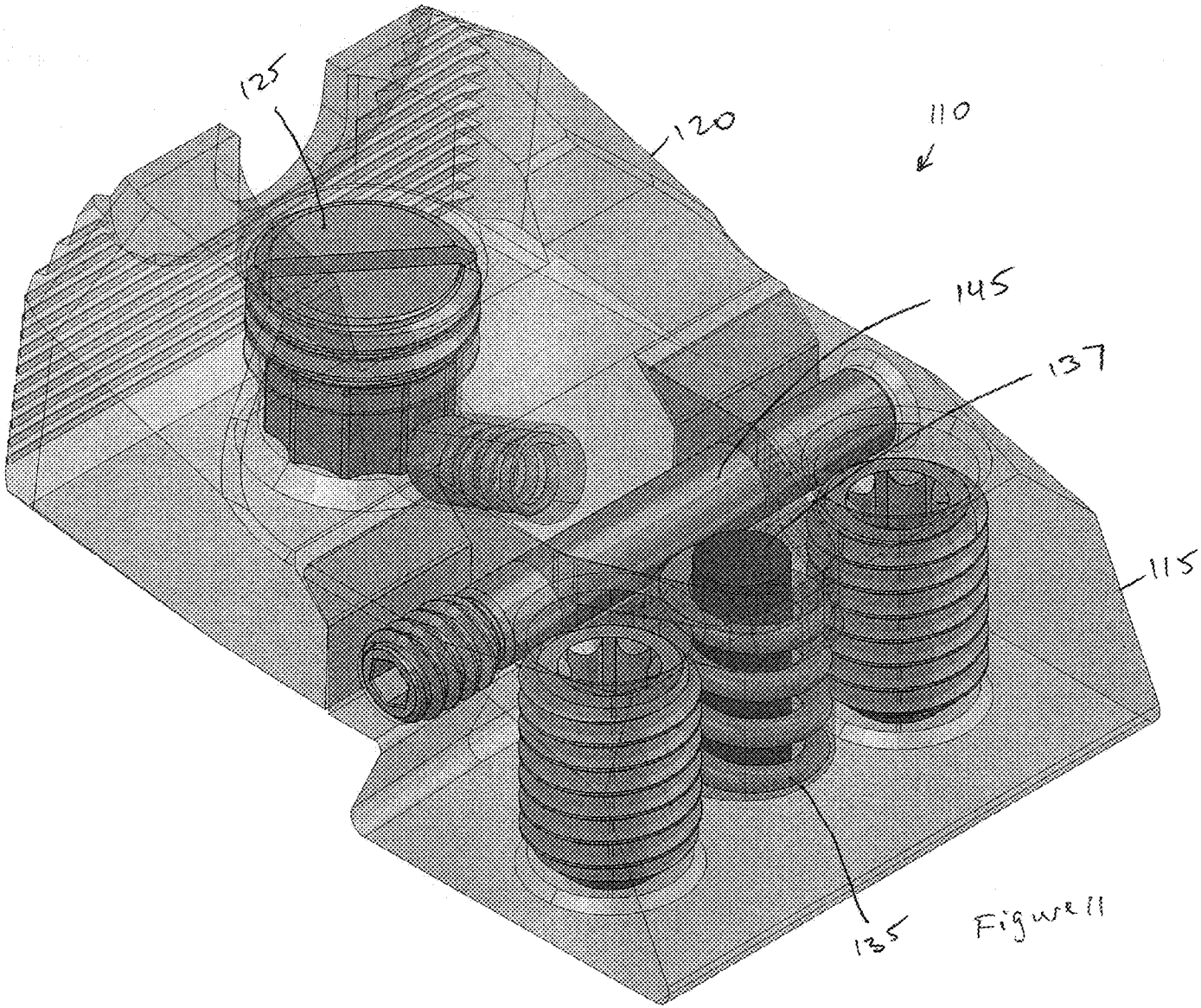
FIG. 11 depicts an assembled, transparent view of the rear sight assembly according to the present disclosure.

According to some embodiments, the sight base 115 is pivotally coupled with the sight blade 120 using a fastener 145 as shown in FIGS. 8-9 and 11. The fastener 145 may be pin, dowel pin, threaded dowel pin, screw, set screw. The sight base 115 may comprise one or more through openings 146 (shown in FIGS. 8-9) configured to accommodate the fastener 145. According to some embodiments, the sight blade 120 may comprise one or more through openings 147 (shown in FIG. 8) configured to accommodate the fastener 145.

According to some embodiments, the sight base 115 comprises a cavity 116 configured to accommodate a protrusion 121 of the sight blade 120. According to some embodiments, the one or more through openings 147 are positioned in the protrusion 121 of the sight blade 20 (shown in FIG. 8). According to some embodiments, the one or more through openings 146 are positioned in the cavity 116 of the sight base 115 (shown in FIGS. 8-9).

The sight blade 120 may comprise a through opening 160 (shown in FIGS. 8-9) configured to accommodate the elevation screw 125. According to some embodiments, at least a portion of the through opening 160 comprises internal threads 161 and at least a portion of the elevation screw 125 comprises corresponding external threads 127 to allow the elevation screw 125 to rotationally move up and down within the through opening 160. According to some embodiments, a lower portion 126 (shown in FIG. 9) of the elevation screw 125 is configured to rotationally enter the through opening 160 from the top end and rotationally exit the through opening 160 from a bottom end to abut the slide 112 as shown in FIGS. 12-13.

Referring to FIGS. 8-9, the protrusion 121 of the sight blade 120 may comprise an extended section 152 according to some embodiments presently disclosed. The extended section 152 comprises a bottom surface 153. The cavity 116 of the sight base 115 may comprise a support surface 191 (shown in FIG. 10) according to some embodiments presently disclosed. The tension member 35 may be positioned between the bottom surface 153 and the support surface 191. According to some embodiments presently disclosed, the support surface 191 may comprise a cavity (i.e. counterbore) to accommodate a lower portion of the tension member 35. According to some embodiments, the tension member 35 is configured to apply a vertical force to the bottom surface 153 and the support surface 191.

Figure 12:
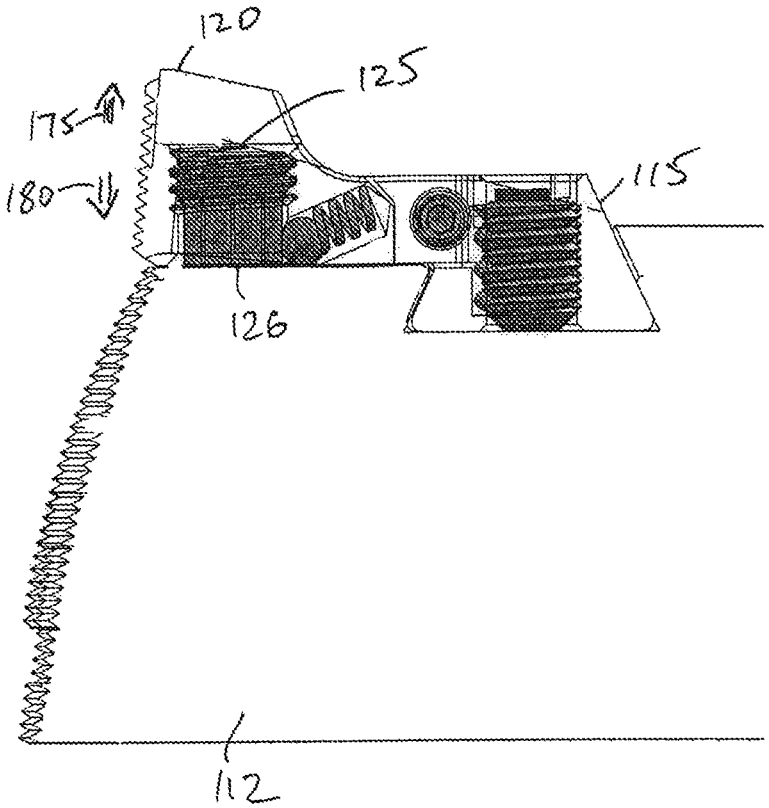
FIG. 12 depicts the rear sight assembly according to the present disclosure coupled with the firearm in a lowered position.
Figure 13:
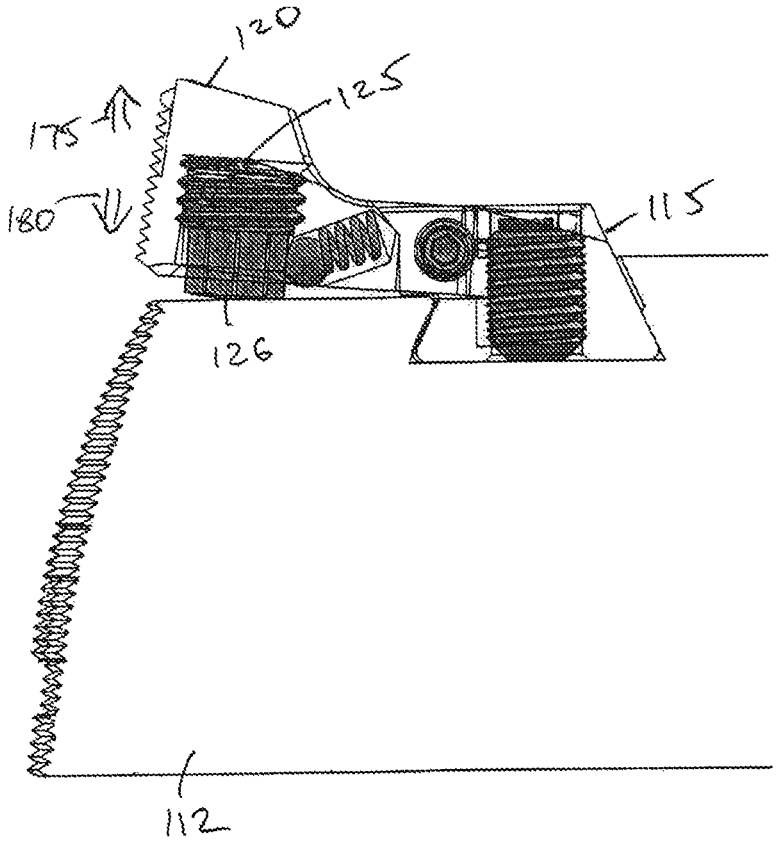
FIG. 13 depicts the rear sight assembly according to the present disclosure coupled with the firearm in a raised position.

According to some embodiments, the sight base 115 is configured to couple with the firearm 114 as shown in FIGS. 12-13. The firearm 114 may comprise an opening 170 (shown in FIG. 8) configured to accommodate at least a portion of the sight base 115. According to some embodiments, the opening 170 is a dovetail opening configured to accommodate a corresponding dovetail shape of the sight base 115.

According to some embodiments, the lower portion 126 (shown in FIG. 9) of the elevation screw 125 is rounded. According to some embodiments, the lower portion 126 of the elevation screw 125 is configured to apply pressure against the firearm 114 (shown in FIGS. 12-13) when it protrudes through the opening 160. According to some embodiments, the sight blade 120 is configured to move in an upward direction shown by reference number 175 as the lower portion 126 of the elevation screw 25 protrudes the through opening 160 as shown in FIGS. 12-13. According to some embodiments, the tension member 135 is being compressed when the sight blade 120 moves in the upward direction 175. Moving the sight blade 120 in the upward direction 175 causes the tension member 135 to be compressed. According to some embodiments, the tension member 135 is configured to urge (i.e. push) the sight blade 120 away from the sight base 115. According to some embodiments, the tension member 135 is configured to urge (i.e. push) the sight blade 120 against the firearm 114.

According to some embodiments, the tension member 135 allows the lower portion 126 of the elevation screw 125 to apply pressure against the firearm 114. According to some embodiments, the compressed tension member 135 keeps the sight blade 120 seated against the firearm 114 during the operation of the firearm 114.

According to some embodiments, the sight blade 120 is configured to move in a downward direction shown by reference number 180 as the lower portion 126 of the elevation screw 125 is retracted back inside of the through opening 160 as shown in FIGS. 12-13. According to some embodiments, the tension member 135 is at least partially decompressed when the sight blade 120 moves in the downward direction 180. Moving the sight blade 120 in the downward direction 180 causes the tension member 135 to at least partially decompress.

Referring to FIGS. 8-9, according to some embodiments, the rear sight assembly 110 may comprise a ball bearing 130 and a spring 140. According to some embodiments, the ball bearing 130 and the spring 140 are disposed in an opening 155 of the sight blade 120. The spring 140 is disposed between the ball bearing 130 and the sight blade 120. According to some embodiments, the ball bearing 130 is 3/32 of an inch in diameter.

According to some embodiments, the elevation screw 125 comprises one or more mating cutouts 190 to accommodate the ball bearing 130. The one or more mating cutouts 190 provide an audible "click" every time the elevation screw 125 is turned and the ball bearing 130 migrates (i.e. transitions) from one matting cutout 190 to another matting cutout 190.

According to some embodiments, the elevation screw 125 comprises ten (10) mating cutouts 190. Therefore, the elevation screw 125 is configured to make an audible "click" every time it is turned 36 degrees. According to some embodiments, each "click" is configured to represent a 0.005 inch of movement of the sight blade 120 in the upward direction 175 or a downward direction 180. According to some embodiments, the sight blade 120 is configured to move 0.09 inches in the upward direction 175.

According to some embodiments, the opening 155 is positioned at a first angle from horizontal to ensure that the ball bearing 130 and the spring 140 are canted (i.e. sloped) downward prior to being installed in the opening 155.

According to some embodiments, the rear sight assembly 110 is angled downward prior to installation on the firearm 14 to guarantee the tension member 135 is constantly under load (i.e. tension, compression) once installed on the firearm 114. This ensures no movement of the rear sight assembly 110 during operation of the firearm 114. According to some embodiments, the tension member 35 is under load (i.e. tension, compression) even if the lower portion 126 of the elevation screw 125 is completely retracted back inside of the through opening 160.

Referring to FIGS. 8-9, according to some embodiments, the rear sight assembly 110 may comprise one or more fasteners 205 to allow a user to adjust the rear sight assembly 110 due to windage. The one or more fasteners 205 may be set screws. The sight base 115 may comprise one or more through openings 211 configured to accommodate the one or more fasteners 205. According to some embodiments, the sight base 115 slides into a mating dovetail 170 of the firearm 114 and is locked into place by the tightening the one or more fasteners 205 through the one or more openings 211. According to some embodiments, the one or more fasteners 205 are 10-32×0.25 inch torx style set screws.

Referring to FIGS. 8-9, according to some embodiments, the rear sight assembly 110 may comprise a buffer 137. The buffer 137 may be positioned within the tension member 135 to provide support and/or rigidity to the tension member 135. The buffer 137 may comprise rubber material.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A rear sight assembly for a firearm, the rear sight assembly comprising:

a sight base coupled with the firearm;

a sight blade pivotally coupled with the sight base; and a tension member positioned between the sight base and the sight blade and configured to push the sight blade against the firearm;

wherein the tension member is a rod and wherein a first portion of the rod is disposed within the sight base and a second portion of the rod is disposed within the sight blade.

2. The rear sight assembly of claim 1 further comprising an elevation screw configured to position the sight blade closer to the firearm or further away from the firearm.

3. The rear sight assembly of claim 1, wherein the sight blade is pivotally coupled directly to the sight base.

* * * * *